United States Patent [19]

Pickering

[11] 4,380,717

[45] Apr. 19, 1983

[54] MAGNETRONS

[75] Inventor: Alan H. Pickering, Chelmsford, England

[73] Assignee: English Electric Valve Company Limited, Chelmsford, England

[21] Appl. No.: 301,815

[22] Filed: Sep. 11, 1981

Related U.S. Application Data

[63] Continuation of Ser. No. 71,714, Aug. 31, 1979.

[30] Foreign Application Priority Data

Sep. 2, 1978 [GB] United Kingdom ..... 35425/78

[51] Int. Cl.[3] ..... H01J 25/50

[52] U.S. Cl. ..... 315/39.51; 313/304; 313/338; 315/39.53

[58] Field of Search ..... 315/39.51, 39.53; 313/338, 302, 304

[56] References Cited

U.S. PATENT DOCUMENTS

| | | | |
|---|---|---|---|
| 2,592,206 | 4/1952 | Sproull | 315/39.51 |
| 2,782,334 | 2/1957 | Gardner | 313/338 |
| 2,832,005 | 4/1958 | Brown | 313/338 |
| 2,932,754 | 4/1960 | Harries et al. | 313/302 |
| 2,953,706 | 9/1960 | Gallet et al. | 313/304 |
| 3,278,791 | 10/1966 | Favre | 313/338 |
| 3,458,753 | 7/1969 | Staats | 313/338 |
| 3,585,438 | 6/1971 | Bell | 313/338 |
| 3,814,972 | 6/1974 | Sain | 313/338 |

*Primary Examiner*—Saxfield Chatmon, Jr.
*Attorney, Agent, or Firm*—Diller, Ramik & Wight

[57] ABSTRACT

A magnetron consists of a cathode structure mounted within an anode cavity arrangement. In order to prolong the operational life of the cathode structure electron emissive material is located within recesses formed in the outer surface of a cylindrical support. As the electron emissive material erodes away during operation of the magnetron its surface area remains substantially unreduced.

13 Claims, 3 Drawing Figures

MAGNETRONS

Figure 1:
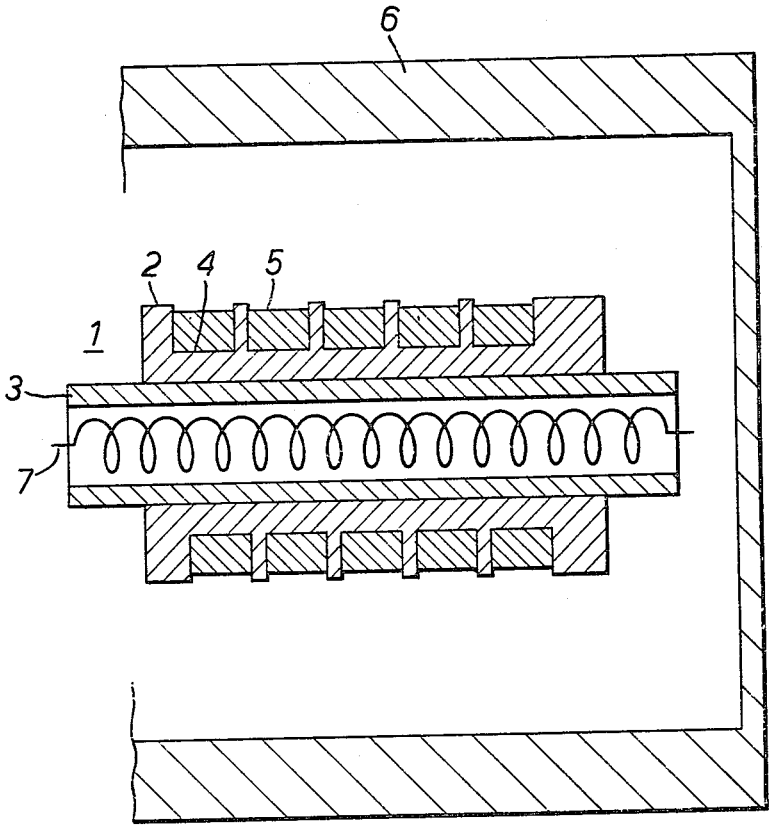

This is a continuation of application Ser. No. 71,714 filed Aug. 31, 1979 of Alan H. Pickering.

This invention relates to magnetrons and is particularly concerned with the cathode structure of a magnetron. Because magnetrons are frequently operated in a pulsed manner, the peak electron current emitted by the cathodes can be very high and electron emissive materials suitable for use in such cathodes generally exhibit poor electrical conductivity and partly because of this the material is eroded during normal operation of the magnetron. This causes the thickness of the electron emissive material to be progressively reduced and this effect is due to the poor electrical conductivity of the material which causes local heating, and is also partly due to sparking and arcing which stems from the granular nature of the electron emissive material. The material is also eroded as result of other actions such as ion bombardment within the magnetron. In order to reduce the erosion of the electron emissive material, it has been proposed to place a resilient open metallic mesh over a cathode support with the interstices of the mesh being filled with electron emissive material. The presence of the mesh increases the effective electrical conductivity of the electron emissive structure of the cathode, thereby reducing to a certain extent the excess local heating and arcing. However, even though the rate of erosion may be slightly reduced, the thickness of the electron emissive material continues to decrease during normal operation and the surface area of the mesh itself is increasingly exposed. The surface area of the electron emissive material is correspondingly reduced to the point where electron emission is insufficient to support proper operation of the magnetron.

The present invention seeks to provide a magnetron in which the magnitude of this difficulty is at least reduced.

According to this invention a magnetron includes a cathode in which a cylindrical support of good electrical conductive material carries electron emissive material located in recesses formed in its outer cylindrical surface, the walls of the recesses being shaped so that as the volume of electron emissive material decreases during operation of the magnetron, the electron emissive surface area remains substantially unreduced.

Preferably the recesses consist of grooves having substantially parallel sided walls over at least a significant proportion of their depth. The grooves are preferably formed by a cutting or abrasion machining process. The grooves may run circumferentially round the cylindrical support, they may be helical or they may be longitudinal grooves aligned with the axis of the cylindrical support. If helical, the recesses can be constituted by a long singlestart helix in the form of a single groove. The width of each groove should be great relative to the width of the intervening cylindrical support so that a sufficiently large electron emissive surface area exists to provide the required electron current density.

Instead of forming the recesses as machined grooves they can be chemically etched in the surface of the cylindrical support and in this case if a suitable etchant resistant mask is used, the cross-sectional area of each recess may increase initially with distance from the surface of the cylindrical support due to the undercutting action of an etchant.

Preferably the support material is a nickel alloy.

Preferably again the electron emissive material includes an oxide of barium.

Preferably again the electron emissive material consists of a mixture of barium strontium and calcium oxides.

Conveniently the electron emissive material is heated to the temperature at which electron emission occurs by the presence of an incandescent filament located in a cavity within the cylindrical support.

Figure 2:
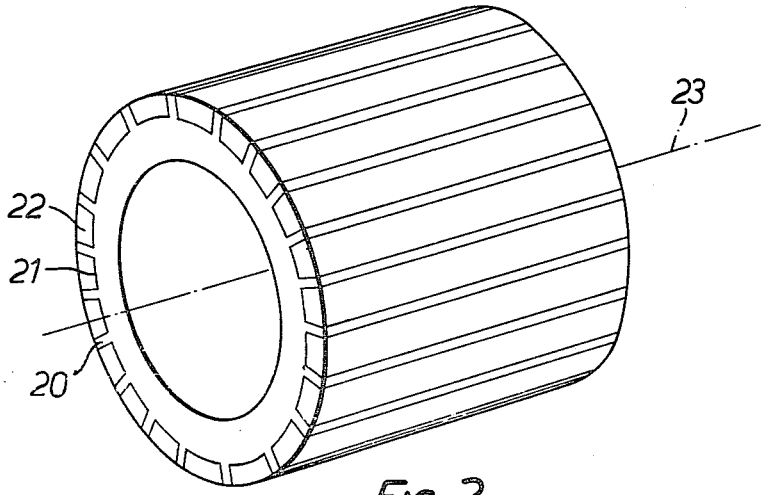
Figure 3:
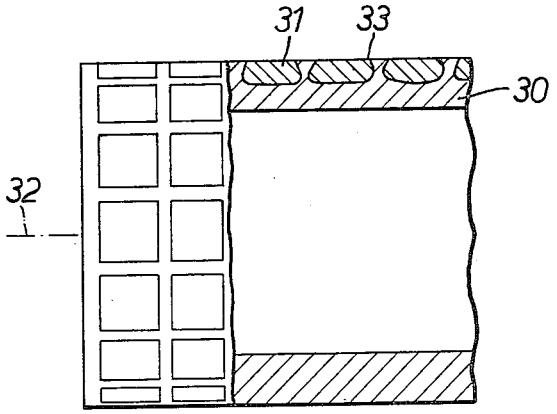

The invention is further described by way of example with reference to the accompanying drawings in which, FIG. 1 shows a much simplified section view of a magnetron in accordance with the present invention and FIGS. 2 and 3 illustrate alternative forms of the cathode used in a magnetron in accordance with the present invention.

Referring to FIG. 1, the magnetron consists of a central cylindrical cathode structure 1, which comprises a cylindrical support 2 mounted on a hollow tube 3, the ends of the tube 3 being securely located so as to correctly position the cathode structure in relation to the anode structure 6 of the magnetron. The support 2 and the tube 3 can be conveniently made of nickel as this is a relatively inert material which exhibits good electrical conductivity and a suitable thermal characteristic. Advantageously the material contains a small proportion of magnesium. The outer surface of the cylindrical support 2 is provided with a number of annular recesses 4 in the shape of circumferential grooves having walls which are substantially parallel to each other. The grooves 4 may be formed by means of a cutting machine and in such a case, the walls may in practice be slightly divergent and the floor of the groove may not be perfectly flat as shown, but may instead be slightly concave. The grooves 4 are filled with an electron emissive material 5, which typically consists of a mixture of oxides of barium, strontium and calcium. The cathode structure 1 is surrounded by an anode structure 6 as is conventional in magnetrons and in practice the usual anode resonant cavities would be provided, although these are not separately indicated on the drawing.

In operation, the electron emissive material 5 is heated by passing an electric current through a helical spiral 7. The spiral 7 is a wire formed of tungsten and is coated with a thin insulating layer of refractory material, such as alumina. The electric current heats the tungsten filament to incandescence and the hollow cathode structure is raised to a temperature of typically about 800° C.—this being the temperature at which copious emission of electrons from the electron emissive material 5 is obtained. During the normal life of the magnetron the depth of the material 5 reduces as its outer surface is eroded or vapourises. However, the effective surface area of the electron emissive material is not reduced substantially until the material is almost entirely used up. Because the grooves run circumferentially around the cylinder, the perimeter of the electron emissive surface will, of course, reduce slightly as its thickness decreases, but since the depth of the groove 4 is extremely small relative to the diameter of the outer surface of the cylindrical support 2, the reduction in electron emissive surface area due to this effect is insignificant.

Although in FIG. 1 the recesses are in the form of separate annular grooves, they may instead more conveniently be machined in the form of helical spirals either as multistart helices or as a single start helix.

An alternative cathode structure is illustrated in FIG. 2 in which a cylindrical support 20 is provided with grooves 21 running longitudinally along the outer cylindrical surface so as to align with the axis 23 of the support 20. The grooves 21 are filled with electron emissive material 22 and this material can be of the same nature as that used in connection with FIG. 1. Because the depth of the grooves 21 is extremely small compared to the overall diameter of the cylindrical support 20 the opposite walls of each groove may be radial with respect to the axis 23 but may be regarded to a first approximation as being substantially parallel to each other.

A further form which the cathode structure 1 may take is shown in FIG. 3 in which the outer surface of a cylindrical support 30 having an axis 32 is etched to form a number of shallow rectangular recesses 31. The surface shape of the recesses is determined by means of a suitable mask which is resistant to the etchant used, and due to undercutting of the cylinder at the edges 33 of the apertures formed in the mask, the cross-sectional area initially increases with depth.

In each case after the required recesses have been formed in the outer surface of the cylindrical support the electron emissive material can be applied as a viscous fluid in which the oxides are applied as a fine powder of carbonates in suspension. The suspension may either be painted on or rolled on so as to fill the recesses and subsequently allowed to dry after which excess material is removed. When the cathode is initially heated the remaining fluid in which the powder was suspended is driven off and the carbonates are composed to form the required oxides.

Typically the width of each groove 4 shown in FIG. 1 is about 0.008 inch, and the intervening wall thickness is about 0.002 inch, although wide variations are possible.

I claim:

1. A magnetron including a cathode in which a cylindrical support of good electrical conductivity material carries electron emissive material located in recesses formed in the outer cylindrical surface to provide an electron emissive surface area of a predetermined area having interruptions formed by walls of the exposed outer, cylindrical surface, the recesses having substantially constant cross sectional area in the direction of their depth so that as the volume of electron emissive material decreases during operation of the magnetron, said electron emissive surface area remains substantially unreduced.

2. A magnetron as claimed in claim 1 and wherein the recesses consist of grooves having substantially parallel sided walls over at least a significant proportion of their depth.

3. A magnetron as claimed in claim 2 and wherein the grooves are formed by a cutting or abrasion machining process.

4. A magnetron as claimed in claim 2 and wherein the grooves run circumferentially round the cylindrical support.

5. A magnetron as claimed in claim 2 and wherein the grooves are helical.

6. A magnetron as claimed in claim 2 and wherein the grooves are aligned with the axis of cylindrical support.

7. A magnetron as claimed in claim 1 and wherein the recesses are formed by chemically etching the surface of the cylindrical support.

8. A magnetron as claimed in claim 7 and wherein a mask is used to define those areas of the surface of the cylindrical support which are etched so that the cross-sectional area of each recess increases intially with distance from the surface of the cylindrical support due to the undercutting action of the etchant.

9. A magnetron as claimed in claim 1 and wherein the cylindrical support is formed of a nickel alloy.

10. A magnetron as claimed in claim 1 and wherein the electron emissive material includes an oxide of barium.

11. A magnetron as claimed in claim 10 and wherein the electron emissive material consists of a mixture of barium, strontium and calcium oxides.

12. A magnetron as claimed in claim 1 and wherein the electron emissive material is heated to the temperature at which the electron emission occurs by the presence of an incandescent filament located in a cavity within the cylindrical support.

13. A magnetron including a cathode in which a cylindrical support of good electrical conductivity material carries electron emissive material located in recesses formed in the outer cylindrical surface, the lateral dimensions of each recess in at least one given direction being small compared with the overall dimension of the cathode in the same direction whereby a plurality of areas of electron emissive material which are separated by intervening raised portions of said cylindrical support are positioned along said direction, and the area of the outer cylindrical surface which is occupied by said electron emissive material is large as compared to the rest of said outer cylindrical surface, and wherein the recesses have substantially constant cross sectional areas in the direction of their depth so that as the volume of electron emissive material decreases during operation of the magnetron, the electron emissive surface area remains substantially unreduced.

* * * * *